US011250823B2

(12) United States Patent
Yamakoshi

(10) Patent No.: US 11,250,823 B2
(45) Date of Patent: Feb. 15, 2022

(54) MUSICAL INSTRUMENT STAND

(71) Applicant: YAMAHA CORPORATION, Hamamatsu (JP)

(72) Inventor: Tetsuya Yamakoshi, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 15/897,338

(22) Filed: Feb. 15, 2018

(65) Prior Publication Data

US 2018/0247621 A1 Aug. 30, 2018

(30) Foreign Application Priority Data

Feb. 24, 2017 (JP) ..... JP2017-032773

(51) Int. Cl.
*G10G 5/00* (2006.01)
*G10D 13/08* (2020.01)

(52) U.S. Cl.
CPC ..... *G10G 5/005* (2013.01); *G10G 5/00* (2013.01); *G10D 13/08* (2013.01)

(58) Field of Classification Search
CPC ..... G10G 5/005; G10G 5/00; G10D 13/08
USPC ..... 84/402
See application file for complete search history.

(56) References Cited

U.S. PATENT DOCUMENTS 6,245,978 B1 * 6/2001 Stevens ..... G10D 13/08 84/402
6,696,628 B2 * 2/2004 Yoshida ..... G10D 13/08 84/321
8,049,089 B2 * 11/2011 Stevens ..... G10D 13/08 84/402
2003/0029299 A1 2/2003 Yoshida

FOREIGN PATENT DOCUMENTS

JP S6122098 U 2/1986
JP 3656620 B2 6/2005

OTHER PUBLICATIONS

Extended European Search Report issued in European Appln No. 18156098.8 dated Jul. 3, 2018.
Office Action issued in Japanese Application No. 2017-032773 dated Feb. 5, 2019. English translation provided.

* cited by examiner

*Primary Examiner* — Jianchun Qin
(74) *Attorney, Agent, or Firm* — Rossi, Kimms & McDowell LLP

(57) ABSTRACT

A musical instrument stand, including: a stand including a plurality of leg columns, a height of each of the plurality of leg columns being adjustable; a musical instrument mount which is installed on the stand and on which a musical instrument is to be mounted; and a connector including an elastic member and connecting the stand and the musical instrument mount.

15 Claims, 4 Drawing Sheets

MUSICAL INSTRUMENT STAND

CROSS REFERENCE TO RELATED APPLICATION

The present application claims priority from Japanese Patent Application No. 2017-032773, which was filed on Feb. 24, 2017, the disclosure of which is herein incorporated by reference in its entirety.

BACKGROUND

Technical Field

The following disclosure relates to a musical instrument stand.

Description of Related Art

Patent Literature 1 (Japanese Patent No. 3656620) discloses a musical instrument stand including: a musical instrument mount on which a tone bar percussion instrument such as a marimba is mounted; and universal joints for adjusting an angle of the musical instrument mount. The disclosed musical instrument stand enables easy height adjustment owing to the universal joints.

SUMMARY

However, the universal joints are generally expensive, and the musical instrument stand inevitably becomes expensive.

Accordingly, the present disclosure relates to a musical instrument stand which is inexpensive and which enables easy height adjustment.

In one aspect of the disclosure, a musical instrument stand including: a stand including a plurality of leg columns, a height of each of the plurality of leg columns being adjustable; a musical instrument mount which is installed on the stand and on which a musical instrument is to be mounted; and a connector including an elastic member and connecting the stand and the musical instrument mount.

The musical instrument stand according to the present disclosure is inexpensive and easy in height adjustment.

BRIEF DESCRIPTION OF THE DRAWINGS

The objects, features, advantages, and technical and industrial significance of the present disclosure will be better understood by reading the following detailed description of one embodiment, when considered in connection with the accompanying drawings, in which.

DETAILED DESCRIPTION OF THE EMBODIMENT

Figure 1:
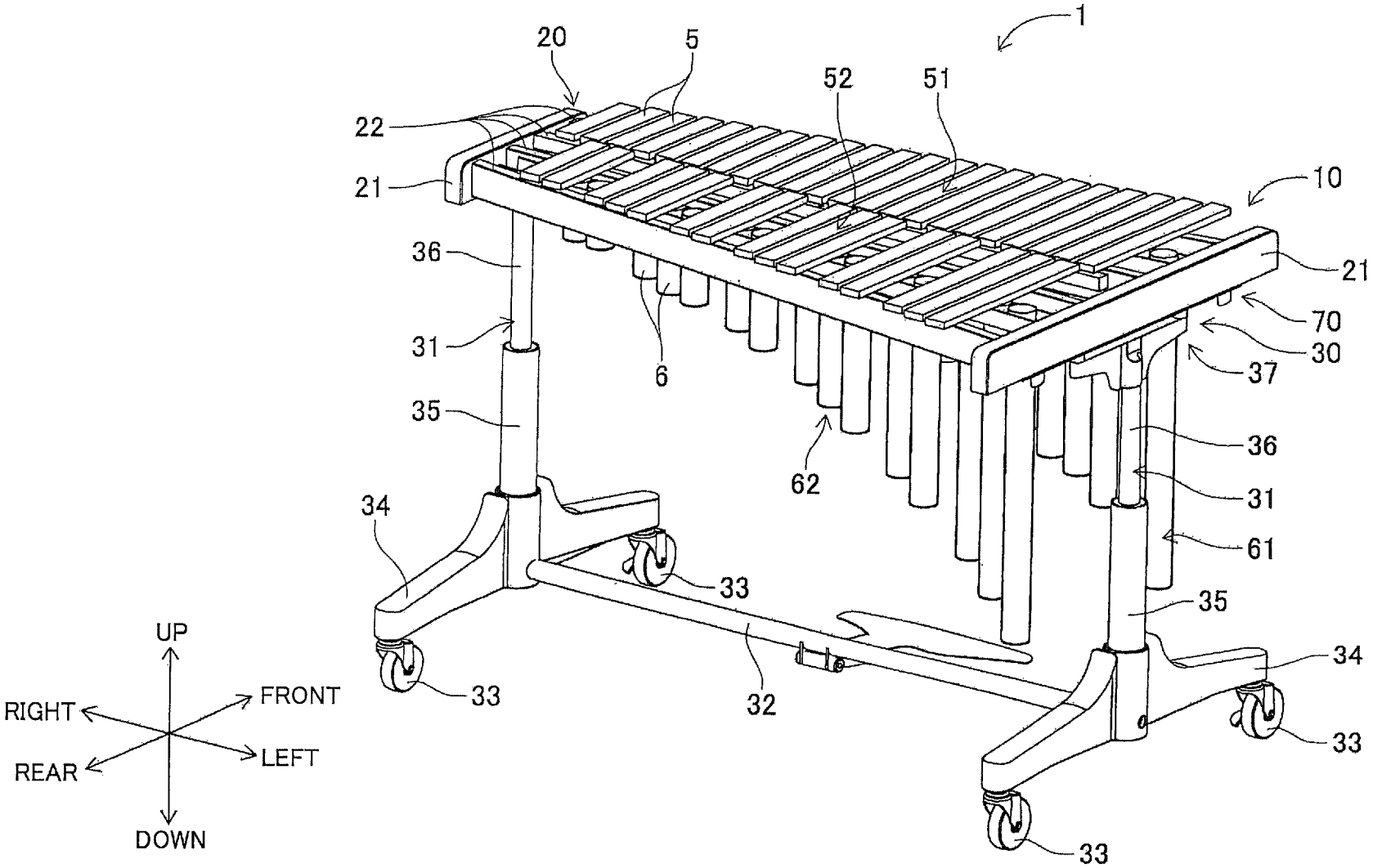
FIG. 1 is a perspective view of a vibraphone including a musical instrument stand according to one embodiment.

Referring to FIG. 1, there will be explained an overall structure of a vibraphone 1 including a musical instrument stand 10. Here, directions shown in FIG. 1 are defined with respect to a direction in which a player sees the vibraphone 1 when playing the vibraphone 1. Specifically, one and the other end portions of the vibraphone 1 respectively located on the left side and the right side when the vibraphone 1 is viewed from the player correspond to a left end portion and a right end portion of the vibraphone 1, respectively. Thus, a right-left direction is defined. One and the other end portions of the vibraphone 1 respectively located on one side nearer to the player and the other side remote from the player when the vibraphone 1 is viewed from the player correspond to a front end portion and a rear end portion of the vibraphone 1, respectively. Thus, a front-rear direction is defined. The vibraphone 1 includes a natural tone bar portion 51, an accidental tone bar portion 52, a natural tone pipe portion 61, an accidental tone pipe portion 62, and the musical instrument stand 10.

The musical instrument stand 10 includes a musical instrument mount 20, a stand 30, and connectors 70. On the musical instrument mount 20, the natural tone bar portion 51, the accidental tone bar portion 52, the natural tone pipe portion 61, and the accidental tone pipe portion 62 are mounted. The musical instrument mount 20 includes a pair of side frames 21, 21 and four rails 22. The side frames 21, 21, each shaped like a bar, constitute right and left sides of the frame-like musical instrument mount 20. Two of the four rails 22, each shaped like a bar, constitute front and rear sides of the frame-like musical instrument mount 20, and another two of the four rails 22 are disposed at substantially the middle in the front-rear direction.

The stand 30 includes: a pair of right-side and left-side leg columns 31, 31 whose heights are adjustable; and a connecting bar 32 connecting the leg columns 31, 31.

Each leg column 31 includes casters 33, 33, a base 34, a cylinder 35, a piston rod 36, and a supporter 37. The casters 33 are attached to the lower surface of the base 34 that extends in the front-rear direction, so as to be located at one and the other of opposite end portions of the base 34 in the front-rear direction. The leg column 31 has a gas spring structure and moves the supporter 37 upward and downward by a gas pressure. The cylinder 35 is fixed at its lower end to the base 34. The supporter 37 is fixed to an upper end portion of the piston rod 36, and a piston (not shown) is attached to a lower end portion of the piston rod 36. The lower end portion of the piston rod 36 is inserted in the cylinder 35 such that the piston is accommodated in the cylinder 35. An inner space of the hermetically sealed cylinder 35 is divided into two spaces by the piston, i.e., an upper space and a lower space. The two spaces are filled with oil. The lower space is partitioned by a free piston (not shown), and the partitioned space is filled with a compressed gas. The piston has an orifice (not shown) through which the two inner spaces communicate with each other.

There is generated, in the two inner spaces of the cylinder 35, a force to move the piston upward or downward by the pressure of the compressed gas. Specifically, the force generated in the upper space moves the piston toward the lower space, and the force generated in the lower space moves the piston toward the upper space. The piston rod 36 is connected to the upper surface of the piston. Accordingly, an area of a lower surface of the piston contacting the lower inner space is larger than an area of the upper surface of the piston contacting the upper inner space. Thus, the force that moves the piston upward is always larger than the force that moves the piston downward. In a case where a player wishes to raise the positions of the side frames 21, namely, in a case where the player wishes to extend the leg columns 31 in a state in which the side frames 21 and other members are installed on the supporter 37, the player can extend the leg columns 31 with a light force so as to raise the positions of the side frames 21. When a load is applied to the piston rod 36 in the state in which the side frames 21 and other members are installed on the supporter 37, the piston moves upward or downward and the piston rod 36 accordingly extends or contracts depending upon a balance between the applied load and the force that moves the piston upward. Specifically, in the case where the applied load is smaller than a predetermined value, the piston rod 36 extends and the supporter 37 moves upward. On the other hand, in the case where the applied load is larger than the predetermined value, the piston rod 36 contracts and the supporter 37 accordingly moves downward. The length of each leg column 31 is determined or fixed such that a stopper (not shown) provided for the leg column 31 anchors the piston rod 36 at a desired position with respect to the cylinder 35.

The musical instrument mount 20 is installed on the stand 30. The stand 30 and the musical instrument mount 20 are connected by a connector 70 which will be explained.

Each of the natural tone bar portion 51 and the accidental tone bar portion 52 includes a plurality of tone bars 5 arranged in the right-left direction and are bound together by strings (not shown). Each tone bar 5 is a metal plate. The length of the long side of the tone bar 5 is a length in accordance with a tone pitch. The tone bar 5 has insertion holes (not shown) formed at two locations corresponding to nodes of the fundamental vibration, so as to penetrate the tone bar 5 in its width direction. The strings are inserted through the insertion holes of the tone bars, 5 so that the tone bars 5 are bound together. The natural tone bar portion 51 and the accidental tone bar portion 52 are installed on the front portion and the rear portion of the musical instrument stand 10, respectively. Specifically, each of the natural tone bar portion 51 and the accidental tone bar portion 52 is disposed on the corresponding two rails 22.

Each of the natural tone pipe portion 61 and the accidental tone pipe portion 62 includes a plurality of pipes 6 arranged in the right-left direction. The pipes 6 are connected to one another to form a row such that upper portions of the pipes 6 are fixed to metal plates (not shown). Each pipe 6 is formed of metal and has a length in accordance with the tone pitch. The pipe 6 is open at its upper end and is closed at its lower end. The natural tone pipe portion 61 is disposed under the natural tone bar portion 51, and the accidental tone pipe portion 62 is disposed under the accidental tone bar portion 52. Specifically, each of the natural tone pipe portion 61 and the accidental tone pipe portion 62 is hung such that opposite ends of the metal plates to which the pipes 6 are fixed are hooked on the side frames 21, 21. One tone bar 5 and one pipe 6 are paired so as to be assigned to one tone pitch. When the tone bar 5 of one pair vibrates, the pipe 6 of the same pair resonates. In FIG. 1, reference sings are attached to only a part of the plurality of tone bars 5 and a part of the plurality of pipes 6.

Figure 2:
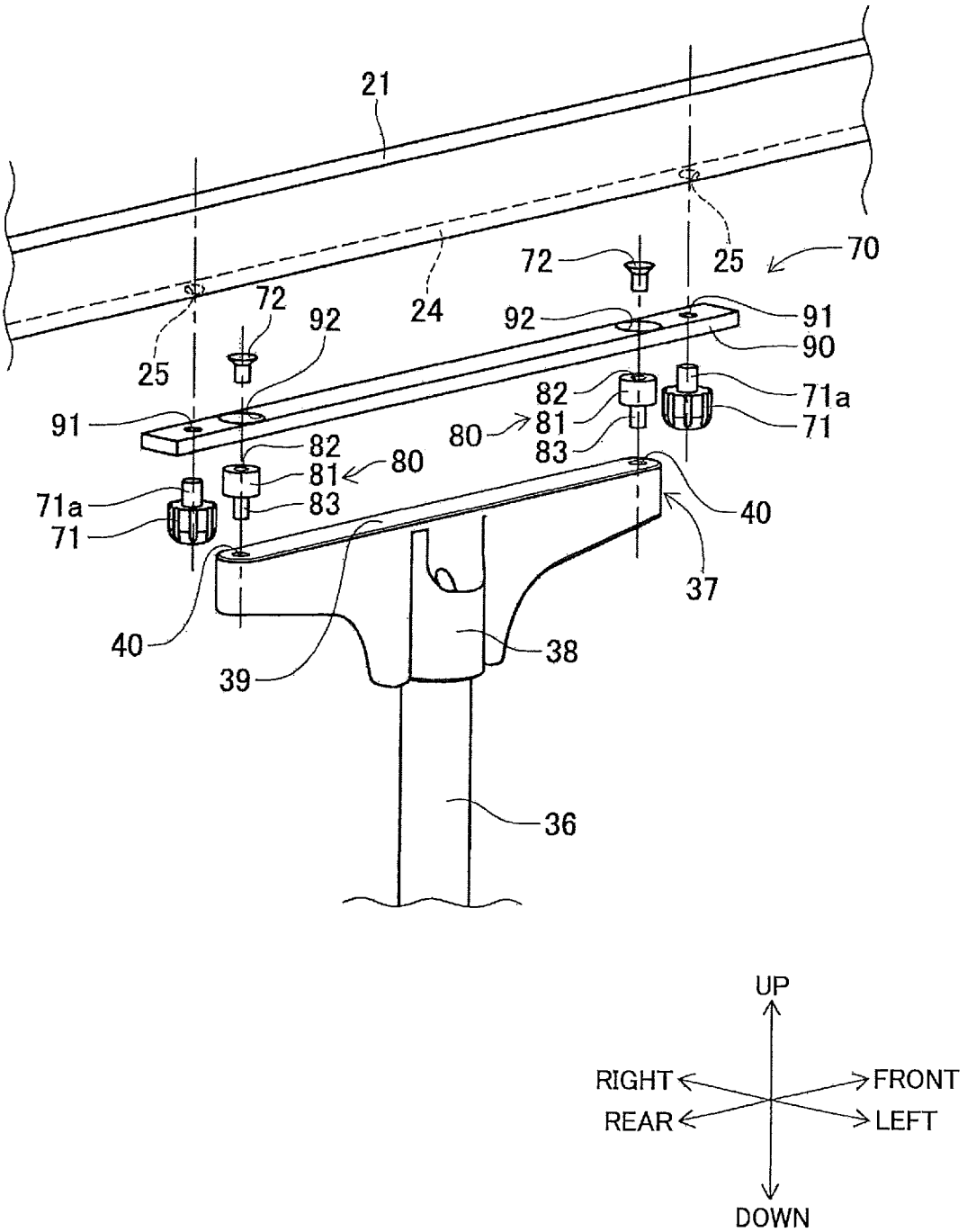
FIG. 2 is an exploded perspective view of a connector.

Referring next to FIG. 2, the connector 70 will be explained. While the connector 70 is provided for each of the two leg columns 31, the following explanation is made focusing on one connector 70. The connector 70 includes rubber members 80, a plate 90, thumb screws 71, and external threads 72. The supporter 37 has a T-like shape. The supporter 37 includes, at its middle portion in the front-rear direction, a receiver portion 38 into which the piston rod 36 is inserted. Internally threaded portions 40, 40 are formed at opposite ends, in the front-rear direction, of an upper surface 39 of the supporter 37. Internally threaded portions 25, 25 are formed at opposite ends, in the front-rear direction, of a facing surface 24 of the side frame 21 which faces the stand 30. The plate 90 extends along the facing surface 24 of the side frame 21 and the upper surface 39 of the supporter 37. The plate 90 has a length in the front-rear direction larger than a length of the upper surface 39 of the supporter 37 in the front-rear direction. The plate 90 has through-holes 91, 91 formed therethrough in the up-down direction at positions corresponding to the internally threaded portions 25, 25 of the side frame 21. The plate 90 further has through-holes 92, 92 formed therethrough in the up-down direction at positions corresponding to the internally threaded portions 40, 40 of the supporter 37. Each thumb screw 71 includes an externally threaded portion 71*a*. Each rubber member 80 is constituted by a rubber portion 81, an internally threaded portion 82 formed of metal, and an externally threaded portion 83 formed of metal, which are formed integrally with each other. The rubber portion 81 is formed of the so-called vibration damping rubber having a vibration damping property for preventing transmission of vibration. The rubber portion 81 has a cylindrical shape. The externally threaded portion 83 of the rubber member 80 and the internally threaded portion 40 of the supporter 37 are threadedly engaged with each other, whereby the rubber member 80 and the supporter 37 are connected. The external thread 72 passing through the through-hole 92 of the plate 90 is threadedly engaged with the internally threaded portion 82 of the rubber member 80, whereby the plate 90 and the rubber member 80 are connected. The externally threaded portion 71*a* of the thumb screw 71 passing through the through-hole 91 of the plate 90 is threadedly engaged with the internally threaded portion 25 of the side frame 21, whereby the plate 90 and the side frame 21 are connected.

Figure 3:
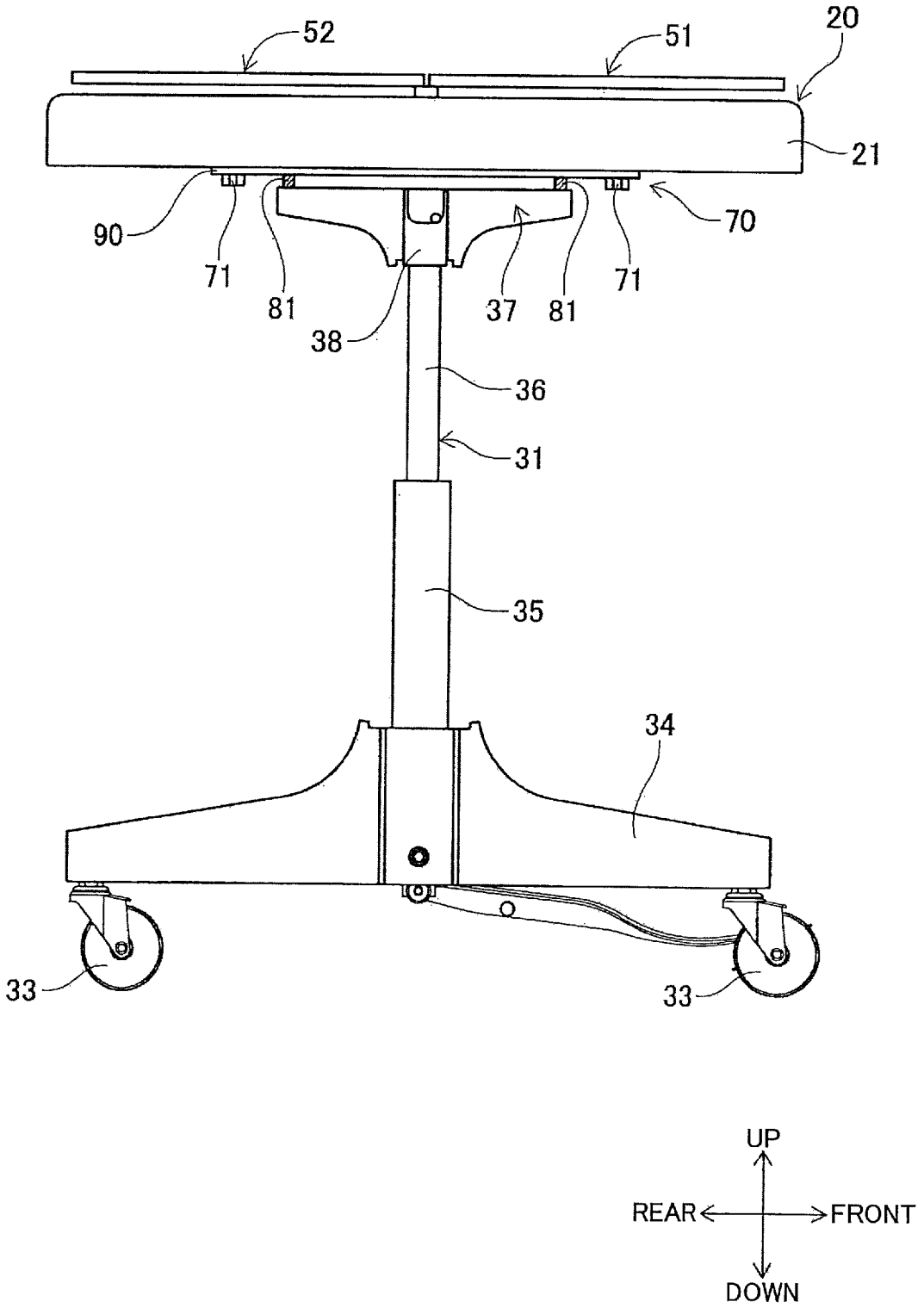
FIG. 3 is a side view of the vibraphone in which pipes are not illustrated.

As shown in FIG. 3, in a state in which the side frame 21 and the supporter 37 are connected through the plate 90, the plate 90 is held in contact with the underside of the side frame 21, and the rubber portion 81 of the rubber member 80 is interposed between the plate 90 and the supporter 37.

Figure 4:
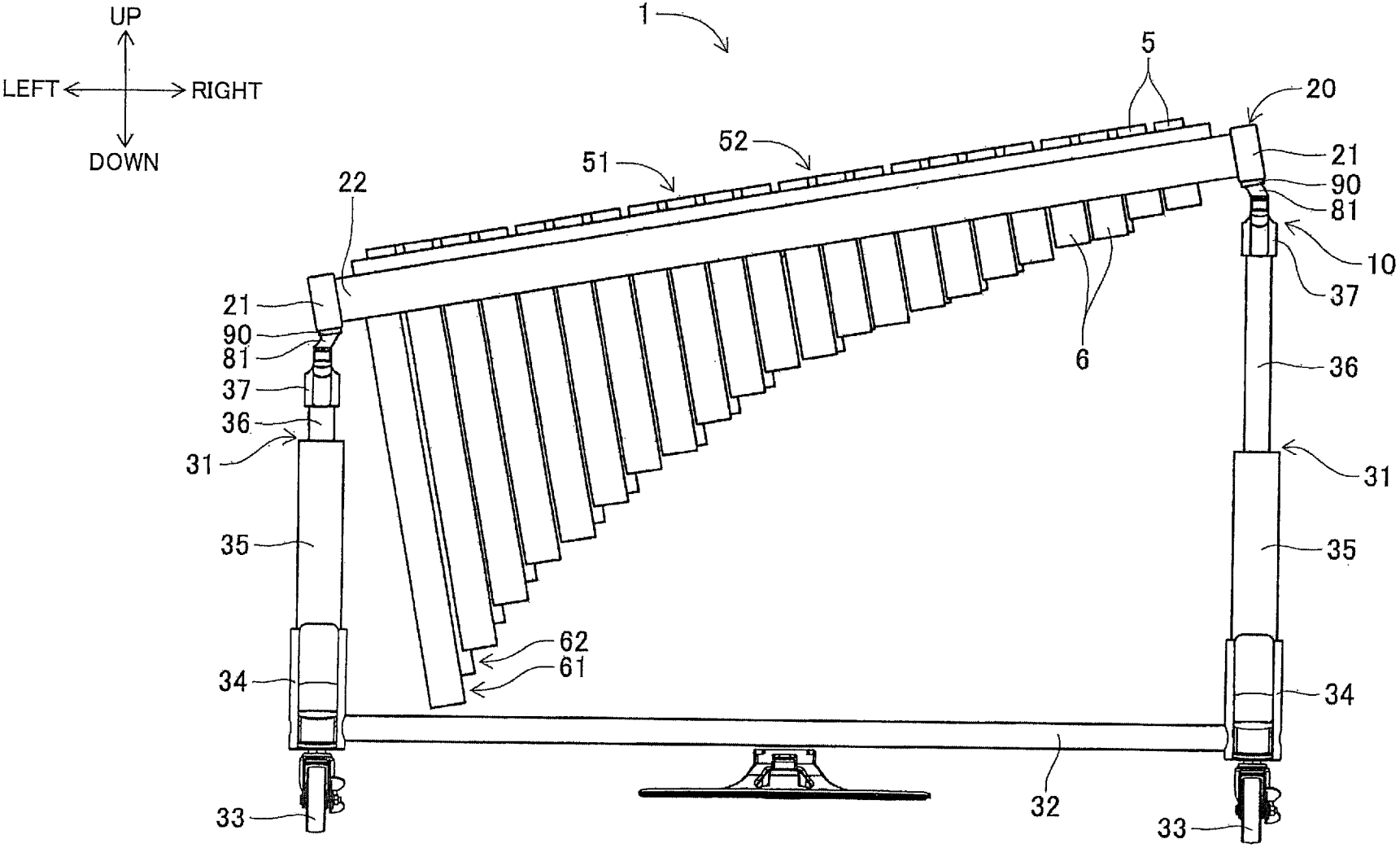
FIG. 4 is a front view of the musical instrument stand in a state in which two leg columns have mutually different heights.

The vibraphone 1 has a dimension in the right-left direction as long as about 2 m. Further, the natural tone bar portion 51 and the natural tone pipe portion 61 are heavy. Thus, in the case the player wishes to raise the position of the musical instrument mount 20 in a state in which the natural tone bar portion 51 and the natural tone pipe portion 61 are mounted thereon, it is difficult for the player to lengthen (extend) the two leg columns 31 at the same time by himself/herself. Here, the connector 70 includes the rubber portions 81. Thus, it is possible to adjust the heights of the respective two leg columns 31 one by one. FIG. 4 illustrates the vibraphone 1 in a state in which the right-side leg column 31 is higher than the left-side leg column 31. In this instance, the rubber portions 81 are elastically deformed and connect the musical instrument mount 20 and the stand 30. That is, in a state in which the musical instrument mount 20 is connected to the stand 30 as shown in FIG. 4, each rubber portion 81 as an elastic member allows an axial direction of the externally threaded portion 71*a* (FIG. 2) threadedly engaged with the internally threaded portion 25 and an axial direction of the externally threaded portion 83 (FIG. 2) threadedly engaged with the internally threaded portion 40 to extend in mutually different directions. Thus, even when the two leg columns 31 have mutually different heights, the stand 30 and the connectors 70 enable the musical instrument mount 20 to be supported in an inclined posture with respect to the floor surface on which the vibraphone 1 is placed. It is therefore possible for the player to adjust the heights of the respective two leg columns 31 one by one, allowing easy height adjustment.

The rubber portion 81 has durability to such an extent that the rubber portion 81 is not torn even if the musical instrument mount 20 is repeatedly placed in the inclined state shown in FIG. 4. Further, the rubber portion 81 has a strength to withstand a tensile force. For example, an unskilled worker may erroneously holds the lower surface of the musical instrument mount 20 in carrying the vibraphone 1 so as to lift up the musical instrument mount 20. In this case, because the musical instrument mount 20 is connected to the stand 30 via the rubber portions 81, the weight of the stand 30 acts on the rubber portions 81. In the present arrangement, the rubber portions 81 have a strength to withstand the weight of the stand 30, so that the rubber portions 81 are prevented from being torn and the stand 30 is accordingly prevented from falling.

In a case where the tone bars 5 vibrate when the vibraphone 1 is played, the rubber portions 81 prevent or reduce transmission of vibration to the leg columns 31 via the musical instrument mount 20, so as to prevent or reduce transmission of vibration to the floor on which the vibraphone 1 is placed. Further, the rubber portions 81 prevent or reduce transmission of vibration from the floor to the musical instrument mount 20, so that it is possible to reduce noise that impairs sound generation by vibration of the tone bars 5 and the pipes 6 when the vibraphone 1 is played.

The vibraphone 1 is formed by assembling individual separable portions, such as the natural tone bar portion 51, the accidental tone bar portion 52, the natural tone pipe portion 61, the accidental tone pipe portion 62, the musical instrument mount 20, and the stand 30. Thus, the player can disassemble individual portions and load and carry them on a vehicle, for instance. For disengaging the connection between the musical instrument mount 20 and the stand 30, the thumb screws 71 are loosened, and the side frame 21 and the plate 90 are disconnected from each other. It may be considered that the side frame 21 is provided with external threads in place of the internally threaded portions 25. Owing to the internally threaded portions 25, however, the side frame 21 has no protrusions. Consequently, the side frame 21 can be placed on the floor or the like with high stability when disconnected from the plate 90. Further, the internally threaded portions 25 obviate a processing applied to the upper surface of the side frame 21 for forming holes into which external threads are inserted, resulting in a good appearance of the vibraphone 1.

The musical instrument stand 10 is one example of "musical instrument stand", the stand 30 is one example of "stand", the musical instrument mount 20 is one example of "musical instrument mount", the connector 70 is one example of "connector", and the leg column 31 is one example of "leg column". The natural tone bar portion 51, the accidental tone bar portion 52, the natural tone pipe portion 61, and the accidental tone pipe portion 62 are one example of "musical instrument". The plate 90, the thumb screw 71, the external thread 72, and the internally threaded portion 82 are one example of "first connecting portion", the externally threaded portion 83 is one example of "second connecting portion", and the rubber portion 81 is one example of "elastic member". The plate 90 is one example of "plate", and the thumb screw 71 is one example of "fixing member". The externally threaded portion 71*a* is one example of "first externally threaded portion", and the internally threaded portion 25 is one example of "first internally threaded portion". The externally threaded portion 83 is one example of "second externally threaded portion", and the internally threaded portion 40 is one example of "second internally threaded portion". The axial direction of the externally threaded portion 71*a* is one example of "first axial direction", and the axial direction of the externally threaded portion 83 is one example of "second axial direction". The external thread 72 is one example of "third externally threaded portion", and the internally threaded portion 82 is one example of "third the internally threaded portion".

The embodiment explained above offers the following advantages.

The connector 70 includes the rubber portions 81. Owing to the rubber portions 81, the musical instrument mount 20 can be supported even when the two leg columns 31 become uneven in height. Thus, the player can adjust the heights of the leg columns 31 one by one, so that height adjustment is easily performed. The rubber portions 81 are inexpensive as compared with universal joints, and the musical instrument stand 10 is accordingly offered at an inexpensive cost.

Each rubber portion 81 is interposed between: the plate 90 connected to the musical instrument mount 20, the thumb screw 71, the external thread 72, and the internally threaded portion 82; and the externally threaded portion 83 connected to the supporter 37. With this configuration, the connector 70 enables the musical instrument mount 20 and the stand 30 to be connected to each other with high reliability via the rubber portions 81.

The rubber portions 81 and the musical instrument mount 20 are fixed on the facing surface 24 of the side frame 21 by the thumb screws 71 via the plate 90. With this configuration, the musical instrument mount 20 can be easily removed from the stand 30 by releasing the fixation by the thumb screws 71, ensuring easy conveyance. Further, the rubber portions 81 and the musical instrument mount 20 are fixed on the facing surface 24, resulting in a good appearance of the musical instrument mount 20.

The side frame 21 includes, on its facing surface 24, the internally threaded portions 25, and the externally threaded portions 71*a* of the thumb screws 71 passing through the respective through-holes 91 of the plate 90 are threadedly engaged with the respective internally threaded portions 25, whereby the plate 90 and the side frame 21 are connected. The facing surface 24 includes the internally threaded portions 25 and thus has no protrusions. Therefore, when the musical instrument mount 20 and the plates 90 are disengaged from each other, the musical instrument mount 20 can be placed on the floor or the like with high stability.

When the two leg columns 31 become uneven in height, the rubber portions 81 are elastically deformed so as to support the musical instrument mount 20 and prevent or reduce transmission of vibration from the musical instrument mount 20 to the stand 30. With this configuration, when the tone bars 5 and the pipes 6 are vibrated in performance of the vibraphone 1, it is possible to prevent or reduce transmission of vibration to the floor on which the vibraphone 1 is placed.

The externally threaded portion 83 is formed integrally with the rubber portion 81, resulting in a reduction in the number of components. Further, the externally threaded portion 83 is formed integrally with the rubber portion 81 and is threadedly engaged with the internally threaded portion 40, whereby the rubber portion 81 can be easily attached to the stand 30. Moreover, the internally threaded portion 82 is formed integrally with the rubber portion 81, and the plate 90 disposed above the rubber portion 81 is attached by the externally thread 72 which is threadedly engaged with the internally threaded portion 82, whereby the plate 90 can be attached to the rubber portion 81, and the plate 90 can be attached to the stand 30 via the rubber portion 81.

It is to be understood that the present disclosure is not limited to the details of the illustrated embodiment, but may be embodied with various changes and modifications which may occur to those skilled in the art without departing from the scope of the present disclosure.

For instance, in the illustrated embodiment, the two rubber members 80 are fixed to the single supporter 37 at the respective opposite end portions of the supporter 37 in the front-rear direction. The present disclosure is not limited to this configuration. Only one or at least three rubber members 80 may be fixed. The rubber members 80 may be fixed to the supporter 37 at portions other than the opposite end portions in the front-rear direction. The shape of the rubber portion 81 is not limited to the cylindrical shape. For instance, one rubber shaped in a quadrangular prism may be disposed such that its longitudinal direction coincides with the front-rear direction.

In the illustrated embodiment, the rubber member 80 includes the internally threaded portion 82 and the externally threaded portion 83. The present disclosure is not limited to this configuration. The combination of the externally threaded structure and the internally threaded structure may be changed. For instance, the rubber member 80 may include an externally threaded structure for connection with the plate 90 or may include an internally threaded structure for connection with the stand 30. The rubber member 80 and the side frame 21 may be connected not via the plate 90. In this case, the externally threaded portion 71*a* and the externally threaded portion 83 are formed integrally with the rubber member 81, and the externally threaded portion 71*a* and the externally threaded portion 83 are threadedly engaged with the internally threaded portion 25 and the internally threaded portion 40, respectively. The externally threaded portion 71*a* may be formed integrally with the rubber portion 81.

In the illustrated embodiment, the rubber members 80 are disposed near the musical instrument mount 20. The positions of the rubber member 80 in the up-down direction are not limited to those in the illustrated embodiment. For instance, the rubber members 80 may be disposed between the base 34 and the leg column 31.

In the illustrated embodiment, the rubber portion 81 which is a vibration damping rubber is used as the elastic member. The elastic member is not limited to the rubber but may be silicone, elastomer or the like. Further, the elastic member may be a spring, an air spring or the like. It is desirable that the elastic member be elastically deformed when the leg columns 31 become uneven in height and have a strength to prevent breakage.

In the illustrated embodiment, the rubber portion 81 is connected to the plate 90 and the supporter 37 through the internally threaded portion 82 and the externally threaded portion 83 which are formed integrally with the rubber portion 81. The rubber portion 81 may be connected otherwise. For instance, the elastic member such as rubber may be bonded by an adhesive or the like so as to be connected directly to the upper surface 39 and the plate 90. In this case, the bonding strength needs to be large enough to withstand the weight of the stand 30.

In the illustrated embodiment, the natural tone bar portion 51, the accidental tone bar portion 52, the natural tone pipe portion 61, and the accidental tone pipe portion 62 which are sound source of the vibraphone 1 are illustrated as one example of the musical instrument. The present disclosure is not limited to this configuration. For instance, the present disclosure is applicable to sound source of percussion instruments such as a xylophone and a marimba. Further, the present disclosure is applicable to installation of electronic keyboard musical instruments such as a keyboard.

What is claimed is:

1. A musical instrument stand, comprising:

a stand including a plurality of leg columns, a height of each of the plurality of leg columns being individually adjustable;

a musical instrument mount which is installed on the stand and on which a musical instrument is to be mounted; and a connector including an elastic member and connecting the stand and the musical instrument mount such that the connector including the elastic member moves together with a leg column of the plurality of leg columns whose height is being individually adjusted, wherein the connector includes:

a plate extending along a facing surface of the musical instrument mount that faces the stand;

a first fixing member configured to fix the elastic member to the stand;

a second fixing member configured to fix the plate to the elastic member and not to fix the plate to the stand; and a third fixing member configured to fix the plate to the facing surface of the musical instrument mount.

2. The musical instrument stand according to claim 1, wherein the third fixing member includes a third externally threaded portion, wherein the plate has a through-hole that permits the third externally threaded portion to pass therethrough, and wherein the musical instrument mount includes, on the facing surface, a third internally threaded portion which is threadedly engaged with the third externally threaded portion passing through the through-hole.

3. The musical instrument stand according to claim 1, wherein the third fixing member includes a third externally threaded portion which is threadedly engaged with a third internally threaded portion provided in the musical instrument mount, and the first fixing member includes a first externally threaded portion which is threadedly engaged with a first internally threaded portion provided in the stand, and wherein, in a state in which the stand is connected to the musical instrument mount, the elastic member allows a third axial direction and a first axial direction to extend in mutually different directions, the third axial direction being an axial direction of the third externally threaded portion which is threadedly engaged with the third internally threaded portion, the first axial direction being an axial direction of the first externally threaded portion which is threadedly engaged with the first internally threaded portion.

4. The musical instrument stand according to claim 3, wherein the first externally threaded portion is formed integrally with the elastic member.

5. The musical instrument stand according to claim 3, wherein the first externally threaded portion is formed integrally with the elastic member, and wherein the elastic member is attached to the stand by threadedly engaging the second first externally threaded portion with the second first internally threaded portion.

6. The musical instrument stand according to claim 5, wherein the plate is disposed above the elastic member, wherein the second fixing member includes a second externally threaded portion for connecting the plate to the elastic member, and wherein the elastic member includes a second internally threaded portion which is formed integrally therewith and which is threadedly engaged with the second externally threaded portion.

7. The musical instrument stand according to claim 6, wherein the third externally threaded portion passes through the through-hole formed in the plate and is threadedly engaged with the third internally threaded portion.

8. The musical instrument stand according to claim 1, wherein the elastic member is rubber.

9. The musical instrument stand according to claim 1, wherein the elastic member is disposed between a leg column of the plurality of leg columns and the musical instrument mount in a vertical direction.

10. The musical instrument stand according to claim 1, wherein the musical instrument mount includes a side frame disposed above a leg column of the plurality of leg columns and to which the connector is connected.

11. The musical instrument stand according to claim 1, wherein the elastic member is disposed between a leg column of the plurality of leg columns and the musical instrument mount in an extending direction of the leg column.

12. The musical instrument stand according to claim 1, wherein the elastic member is disposed directly on the leg column.

13. The musical instrument stand according to claim 1, wherein each of the plurality of leg columns includes a base, a cylinder extending from the base, a piston rod extending from the cylinder, and a supporter disposed on the piston rod, and the elastic member is disposed on the supporter.

14. The musical instrument stand according to claim 1, wherein each of the plurality of leg columns includes a base, a cylinder extending from the base, a piston rod extending from the cylinder, and a supporter disposed on the piston rod, and the elastic member is disposed directly on the supporter.

15. The musical instrument stand according to claim 1, wherein the elastic member moving together with the leg column of the plurality of leg columns whose height is being individually adjusted becomes elastically deformed when the leg column of the plurality of leg columns whose height is being individually adjusted is adjusted to a height that differs from a height of another leg column of the plurality of leg columns.

* * * * *